US005699660A

United States Patent [19]

Buluschek

[11] Patent Number: 5,699,660

[45] Date of Patent: Dec. 23, 1997

[54] STRANDING STATION FOR REVERSE LAY OR SZ TYPE STRANDING MACHINE

[75] Inventor: Bruno Buluschek, Echandens, Switzerland

[73] Assignee: E. Kertscher S.A., Yvonand, Switzerland

[21] Appl. No.: 683,437

[22] Filed: Jul. 19, 1996

[30] Foreign Application Priority Data

Jul. 26, 1995 [FR] France ..... 95 09089

[51] Int. Cl.[6] ..... D07B 3/00; D07B 7/04

[52] U.S. Cl. ..... 57/293; 57/294; 57/314; 57/92

[58] Field of Search ..... 57/293, 294, 314, 57/92, 204

[56] References Cited

U.S. PATENT DOCUMENTS

| | | | |
|---|---|---|---|
| 4,450,674 | 5/1984 | Bos et al. | 57/293 X |
| 4,467,596 | 8/1984 | Feese et al. | 57/293 |
| 4,586,327 | 5/1986 | Oestreich | 57/293 X |
| 4,773,207 | 9/1988 | Cramer | 57/293 X |
| 4,813,223 | 3/1989 | Nipper et al. | 57/293 X |
| 4,856,266 | 8/1989 | Ogawa et al. | 57/293 X |
| 4,974,408 | 12/1990 | Karhu | 57/293 |
| 5,237,809 | 8/1993 | Oestreich et al. | 57/293 |
| 5,307,617 | 5/1994 | Karhu | 57/294 X |
| 5,551,224 | 9/1996 | Kumpf et al. | 57/293 |

FOREIGN PATENT DOCUMENTS

| | | |
|---|---|---|
| 31081 | 7/1981 | European Pat. Off. . |
| 582802 | 2/1994 | European Pat. Off. . |
| WO9420969 | 5/1994 | WIPO . |

*Primary Examiner*—Daniel P. Stodola
*Assistant Examiner*—Tina R. Taylor
*Attorney, Agent, or Firm*—Sughrue, Mion, Zinn, Macpeak & Seas, PLLC

[57] ABSTRACT

A stranding station (1) for SZ type stranding machines intended for the helical stranding of a plurality of individual wire strands (4a–4g). The stranding station (1) is characterized in that the accumulation element (50) is mounted so as to be free to rotate about and free to move axially along a support shaft (54) driven in rotation, in that the mechanism for driving the accumulation element in rotation includes an intermediate element (60) attached to the support shaft (54), arranged downstream of the accumulation element (50) in relation to the forward motion direction of the wire strands (4a–4g), and in that the intermediate element (60) has a driving surface (62), this accumulation element being driven in rotation by friction on the driving surface (62).

15 Claims, 4 Drawing Sheets

STRANDING STATION FOR REVERSE LAY OR SZ TYPE STRANDING MACHINE

BACKGROUND OF THE INVENTION

The invention concerns a stranding station for a reverse lay stranding machine intended for the production of reverse lay multistranded cables also called SZ type cables. More particularly, the invention concerns a station of this type comprising an accumulation device having a simple and inexpensive construction and whose rotating masses are less significant than those of stranding machine accumulation devices of the prior art.

It is already known, in order to give greater flexibility to a bundle of wire or cable strands of any type (electric wire, optic fibre or suchlike), to strand these wire strands by alternately inducing thereto helical twisting in two opposite directions, respectively direction S and direction Z.

This is achieved with the aid of a stranding machine called an SZ stranding machine in which the strands of wire are supplied from stationary spools in an SZ stranding station in which they are alternatively twisted in two opposite directions and then passed through a stranding die. The wire strands thus stranded are then wound onto a take-up spool which is also stationary after the twisting has been secured, for example with the aid of a tape or by sheathing the cable with a plastic material.

The stranding station comprises, in particular, an accumulation device disposed between a stationary guide plate through which the wire strands pass, which is situated upstream in relation to the direction of movement of the cable, and a stranding disc through which the wire strands also pass and which is alternately driven in rotation in opposite directions. The function of the accumulation device is to assure the regular and rapid forward motion of the wire strands despite the alternate helical twisting of the latter imposed by the stranding disc.

The accumulation device comprises generally a plurality of accumulation discs having guide holes regularly distributed along their circumference through which the wire strands pass. These discs, which are mounted freely to rotate on a common support shaft between the stationary guide plate and the stranding disc which is itself mounted freely to rotate on this shaft, are alternately driven in rotation on the support shaft in opposite directions in conjunction with the driving of the stranding disc.

By way of example, the driving of the stranding disc is achieved by a belt mounted respectively on the periphery of the stranding disc and on a pulley attached to a secondary driving shaft, which is driven by a motor capable of carrying out high speed inversions of the direction of rotation.

The accumulation discs are driven in rotation in a similar fashion to the stranding disc, by belts and pulleys attached to the secondary driving shaft. However, the gear ratios between the accumulation discs are such that their rotation speeds decrease from the stranding disc towards the stationary guide plate.

This type of accumulation device has the major disadvantage of including a large number of moving parts. Since the forward motion speed of the wire strands in the accumulation device, and consequently the cable production speed, are dependent on the maximum speed of the inversions of the direction of rotation of the accumulation discs, it is easily understood that the cable production speed is quickly limited by the number and significance of the rotating masses attached to the motor shaft.

Furthermore, this large number of parts also has an unfavourable effect on the cost and general spatial requirements of the stranding machines.

SUMMARY OF THE INVENTION

A principal aim of the invention is thus to overcome the aforementioned disadvantages of the prior art by providing a stranding station for stranding machines comprising an accumulation device which is simple, compact and economical and which enables in particular the rotation direction inversion speed of the accumulation discs and consequently the stranding speed to be increased.

The invention thus concerns a stranding station for SZ stranding machines intended to join or assemble helically a plurality of individual wire strands, said stranding station comprising:

fixed means for guiding the wire strands, stranding means comprising in particular a stranding element which is able to rotate about an axis, accumulation means disposed between said guide means and said stranding means, comprising at least one accumulation element, said wire strands passing through each of said guide means, said stranding means and said accumulation means, a support shaft extending between the guide means and the stranding means, said support shaft carrying said accumulation means, means for alternately driving said stranding element in rotation in opposite directions, p1 means for driving said accumulation element in rotation simultaneously with said stranding element, characterised in that said support shaft is driven in rotation in conjunction with said stranding element, in that said accumulation element is mounted so that it is free to rotate about said support shaft and free to move axially along said support shaft, in that the rotation driving means of the accumulation element comprise an intermediate element attached to the support shaft, disposed downstream of the accumulation element in relation to the forward motion direction of the wire strands, in that the intermediate element comprises a driving surface, and in that the accumulation element may be applied against said driving surface and thus be driven in rotation by friction of said driving surface against the accumulation element.

As a result of these characteristics, one achieves a stranding station comprising means for driving the accumulation elements of simple, economical construction, requiring little space and which because of their lightness favour high accumulation element rotation direction inversion speeds.

These driving means consist in mounting the accumulation elements so that they are free to rotate and with a certain axial clearance on the support shaft, and in associating each of these elements with an intermediate element which is attached to the support shaft and disposed downstream of each accumulation element in relation to the forward motion direction of the wire strands. Since the wire strands to be stranded which pass through the accumulation elements are subjected to a certain tension due in particular to the winding traction of the cable, these wire strands are in virtually permanent contact with the accumulation elements and the friction of the wire strands against the accumulation elements generates a force having an axial component which applies each accumulation element against the intermediate element which is associated therewith. Each accumulation element, free to rotate on the support shaft, is thus driven by a friction force by its associated intermediate element which is attached to the support shaft. It is thus easily understood that the driving torque of the accumulation elements increases with the size of the axial component of the friction force. Of course, the absolute value of the driving torque depends, on the one hand, on the friction coefficient between the materials forming the accumulation elements and the intermediate elements and, on the other hand, on the radius defined by the distance separating the friction surface of the axis of rotation of the support shaft.

One thus takes advantage of the friction forces inherent in the operation of the station and put into play when the wire strands pass through the accumulation elements.

According to a preferred feature of the invention, the accumulation element has the general shape of a disc and the intermediate element has the general shape of a ring prolonged at one of its ends by a flange comprising on its frontal face the driving surface.

According to another preferred feature of the invention, the flange comprises at its periphery an annular rim extending axially, the frontal face of this rim forming the driving surface.

Other advantages and features of the invention will appear upon reading the detailed description which follows of embodiment examples given by way of illustrative and non-limiting example, in conjunction with the attached drawing in which:

DESCRIPTION OF PREFERRED EMBODIMENTS

The description of the invention will be made within the framework of seven individual strand reverse lay or SZ stranded electric cable manufacturing application, each of the strands being formed of an insulated conducting wire. However, it goes without saying that the invention is in no way limited to this application and that the nature and number of individual wire strands may vary as a function of the cable desired. The invention may, for example, be applied equally advantageously to the manufacture of this type of electric cable comprising a core and formed from non insulated conducting wires, or even to the manufacture of optical cables from wire strands formed by optical fibres.

Figure 1:
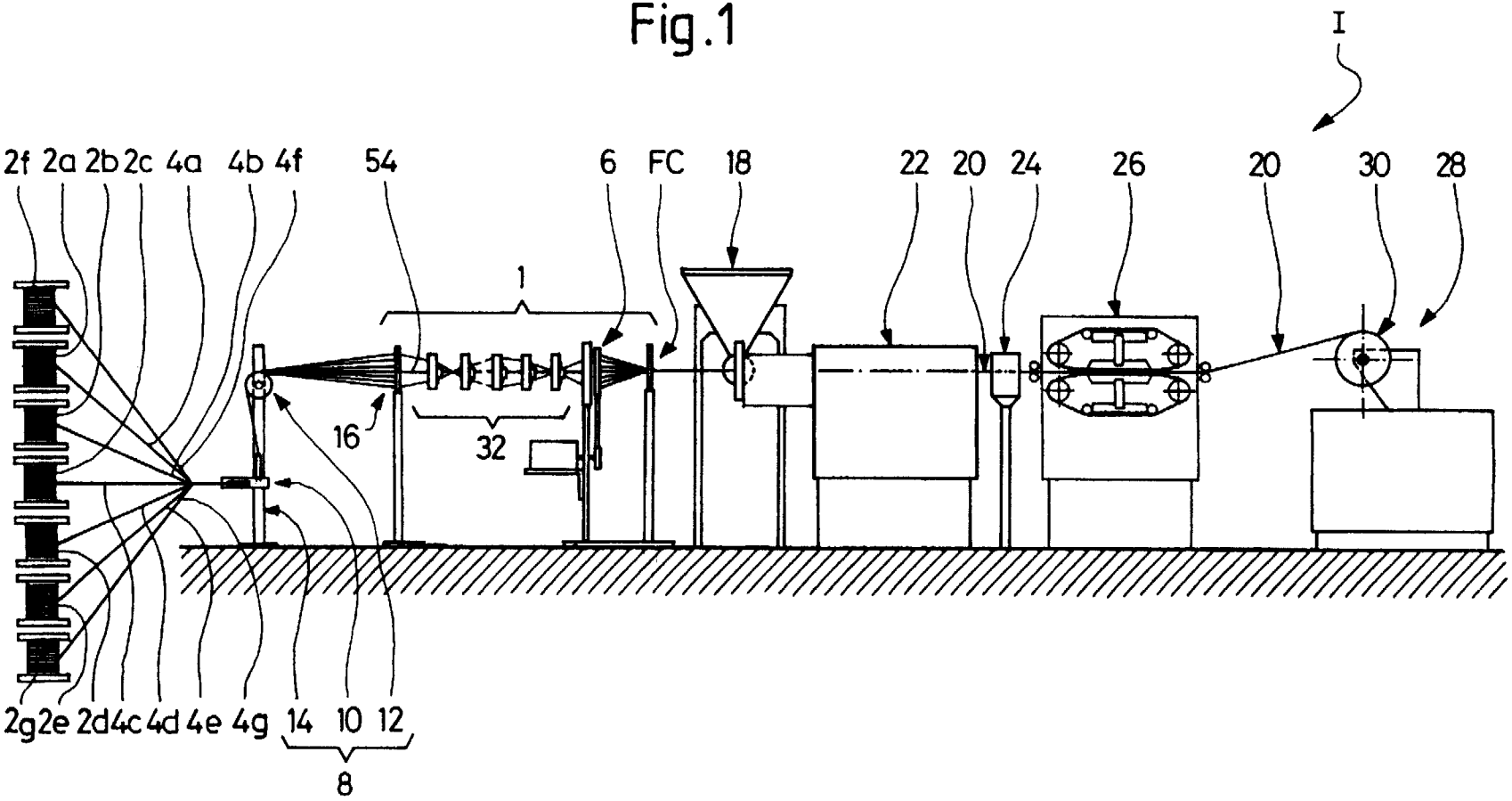
FIG. 1 is a schematic overall view of a cable manufacturing installation incorporating a stranding station according to the invention.

Referring to FIG. 1, one sees a schematic representation of a reverse lay or SZ stranded cable manufacturing installation I comprising a stranding station designated by the general numerical reference 1.

According to the embodiment shown in FIG. 1, installation I comprises, upstream of stranding station 1, seven pay-off spools 2a–2g on which individual wire strands 4a–4g are respectively wound. These spools supply, in a conventional manner, the individual wire strands to stranding station 1 in which individual wire strands 4a–4g are stranded or joined together by twisting in alternate directions by stranding means 6.

In a conventional manner, individual wire strand support and guide means 8 are arranged between pay-off spools 2a–2g and stranding station 1. In the example shown, support means 8 comprise multiple grooved return pulleys 10 and support pulleys 12 which are freely mounted on a stand 14, through which wire strands 4a–4g pass before entering stranding station 1 of the invention via the intermediary of stationary guide means 16.

The individual wire strands stranded or joined by twisting, which come out of stranding station 1 then pass into an extrusion station 18 in which they are sheathed to form a cable 20.

Upon leaving extrusion station 18, cable 20 then passes into a cooling station 22 before being introduced, for drying, into a station 24 and into traction means 26 in which it is pulled and directed towards a receiving station 28 in which it is wound in a conventional manner onto a take-up spool 30.

The different means or stations which have just been briefly described, in particular support means 8, stranding station 1, extrusion station 18, cooling means 22, drying means 24, traction means 26 and receiving station 28, are situated substantially on an axis A-A' (FIG. 2), the general forward motion of the cable being from the left of FIG. 1 towards the right of the latter, or in the direction A-A'.

Figure 2:
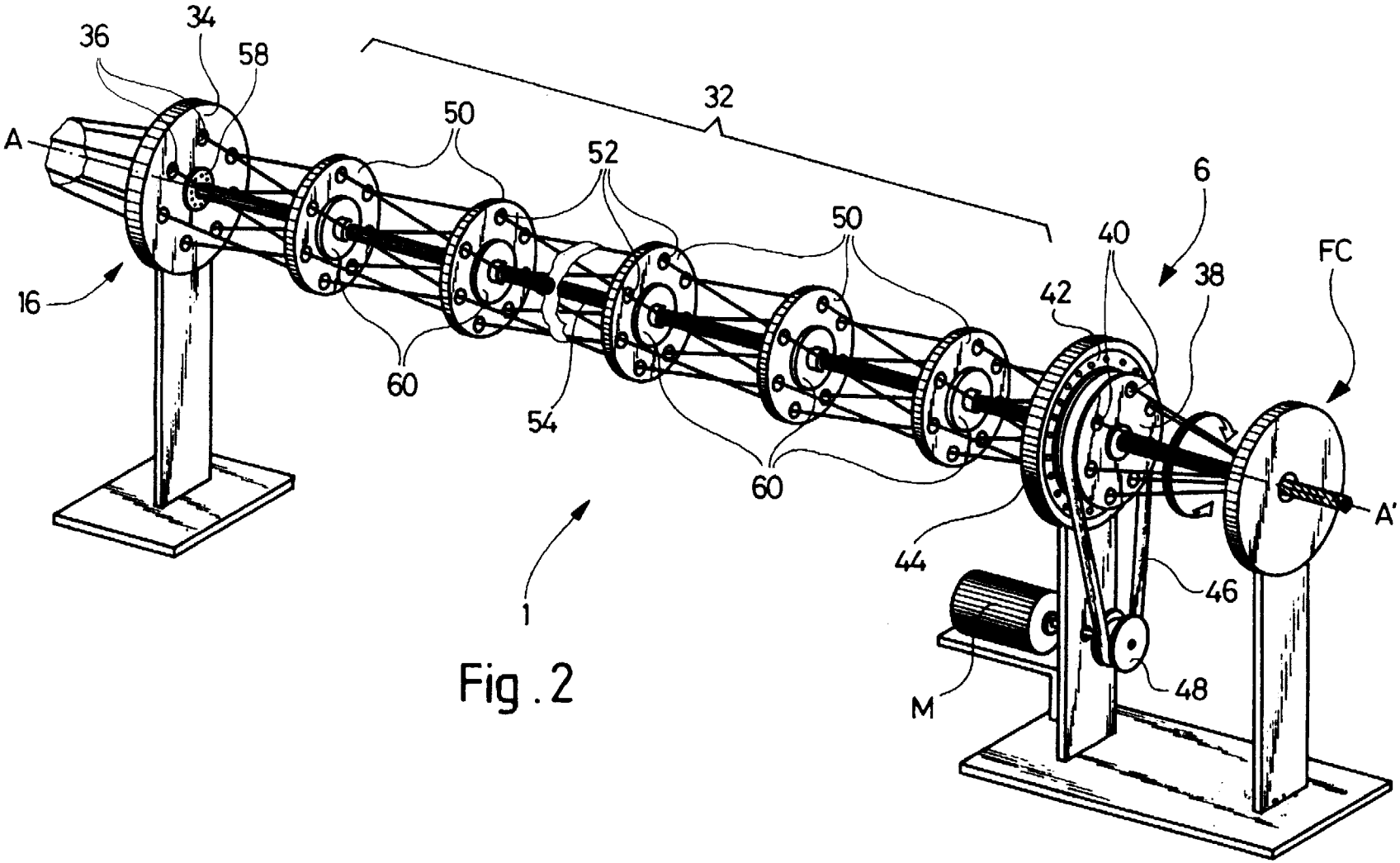
FIG. 2 is a perspective view of the stranding station according to the invention.

Referring also now to FIG. 2, one sees stranding station 1 according to the invention which comprises accumulation means 32 disposed between fixed guide means 16 and stranding means 6, individual wire strands 4a–4g to be stranded passing through all of these means, said wire strands being then joined by a conventional stranding die FC arranged downstream of stranding means 6 in relation to the forward motion direction of the cable.

Guide means 16 are formed in a conventional manner by a plate 34 pierced with guide holes 36 regularly distributed along a circle.

Stranding means 6 are also made in a conventional manner and comprise a stranding disc 38, having guide holes 40 which are also regularly distributed along a circle. Disc 38 is alternately driven in rotation in opposite directions in a bearing 42 mounted on a support plate 44 extending substantially parallel to plate 34. In the example illustrated, the driving is achieved with the aid of a belt 46 extending between stranding disc 38, on the one hand, and a pulley 48 of a motor M on the other hand. The rotation of motor M is controlled by a central control station (not shown) which determines the rotation speed of stranding disc 38 and the frequency of its direction inversion, and which thus determines the angular distance which disc 38 travels before each inversion.

Accumulation means 32 comprise a plurality of identical accumulation elements 50, having the shape of discs and each comprising guide holes 52 regularly distributed around a circle.

It will be noted that the number of holes in guide means 16, in stranding means 6 and in each of accumulation discs 50 is determined by the number of individual wire strands 4a–4g supplied by pay-off spools 2a–2g which pass through these different means. In the example illustrated, this number of holes is equal to seven.

It goes without saying that holes 40 and 52 may according to alternative embodiments be replaced by notches which open out at the periphery of discs 38 and 50 or by any opening having walls enabling a driving in rotation of the individual wire strands to be assured. As regards holes 36, they may be replaced by such equivalent means as long as these means assure a wire strand guiding function.

Accumulation discs 50, which are preferably equidistant from each other, are mounted so as to be free to rotate about and free to move axially along a support shaft 54 which extends between guide means 16 and stranding means 6.

It will be noted in this regard and by way of illustration that if, according to standard ISO/VSM 58400, the diameter of support shaft 54 is executed with a tolerance h7, the diameter of passage 56 (FIGS. 3 and 4) arranged in accumulation discs 50 for the passage of this shaft will have the same diameter executed with the tolerance F7. Accumulation discs 50 will thus be easily axially mobile on shaft 54.

In the example illustrated, support shaft 54 is mounted so as to rotate in a bearing 58 arranged in plate 34, and passes through stranding disc 38 which is attached thereto. Support shaft 54 and stranding disc 38 are thus, according to the invention, driven simultaneously in alternate rotation in opposite directions by motor M at a same rotation speed.

The reasons for which support shaft 54 is driven in rotation while accumulation discs 50 are freely mounted on the latter will appear below in conjunction with the description of the driving means of accumulation elements 50.

In this embodiment example, shaft 54 has the shape of a tube in which the core (not shown) of a cable to be manufactured may move forward prior to the stranding of the wire strands around the latter. Of course support shaft 54 may be a full shaft in the event that the cable to be manufactured does not include a core.

Accumulation means 32 also comprise means for driving in alternating rotation in opposite directions accumulation discs 50 simultaneously with the alternating rotation of stranding disc 38.

These rotation driving means comprise, according to the invention, an intermediate element or driving element 60 attached in rotation and fixed axially with respect to support shaft 54 by any appropriate means and associated with each accumulation disc 50. Each driving element 60 is disposed on shaft 54 downstream of the accumulation disc 50 with which it is associated, in relation to the forward motion direction of the wire strands. Driving elements 60 each comprise a surface 62 called the driving surface (FIG. 3) via which they act on a part of the frontal surface 64 of discs 50 to drive them in rotation by friction.

Since accumulation discs 50 are mounted so as to be free to rotate about and free to move axially along shaft 54, the friction forces generated by the forward motion of the wire strands through accumulation discs 50, in particular when the wire strands are not parallel to the forward motion axis of the cable (FIG. 3, wire strand 4*a*), comprise an axial component which applies discs 50 against friction surface 62 of driving elements 60 thus driving accumulation disc 50 in rotation in conjunction with shaft 54. Since the connection between discs 50 and driving elements 60 is not fixed, the rotation speed of accumulation discs 50 is different from that of shaft 54 and consequently from that of stranding disc 38. Friction forces of discs 50 on support shaft 54 under the effect of gravity are added to these friction forces generated by the wire strands.

It will be noted that the friction forces generated between discs 50 and shaft 54 of course depend upon the weight of discs 50 and the radial component of the friction force generated in the holes of passage 52 by the forward motion of the wire strands drawn by device 26. Given the method of driving discs 50 by friction, there is no particular advantage in reducing these friction forces, for example by mounting discs 50 on support shaft 54 with the aid of ball bearings or suchlike.

The angular distances which accumulation discs 50 respectively travel before inversion in relation to the angular distance which stranding disc travels may thus be selected as a function of the desired friction driving torque to be transmitted to each accumulation disc 50 by driving element 60 which is associated therewith. This driving torque may be selected as a function, on the one hand, of the friction coefficient existing between the material of the parts in friction contact of accumulation discs 50 and driving elements 60, and/or on the other hand, of the distance R (FIG. 3) separating driving surface 62 from the axis of rotation Ar of support shaft 54.

Whatever happens, the friction driving torques of accumulation discs 50 are such that they increase from the accumulation disc 50 closest to guide means 16 to the disc closest to stranding means 6.

In the example illustrated, intermediate or driving elements 60 have the general shape of a ring comprising a body 66 attached to support shaft 54, for example via a weld 68 or any other equivalent means such as a screw and nut system to make the system dismountable, which is extended at one of its ends by a flange 70 which extends facing frontal face 64 of the accumulation disc 50 with which driving element 60 is associated. Flange 70 comprises at its periphery an annular rim 72 which extends axially and whose frontal face forms driving surface 62. Driving surface 62 thus has an annular shape. It is understood that the shape and the dimensions of this surface may be adapted by the man skilled in the art as a function of the materials used and/or the desired driving torque.

In the example illustrated, accumulation discs 50 and driving elements 60 are respectively made in light metal alloys, for example an aluminium alloy, and preferably comprising recesses (not shown) enabling them to be made as light as possible and thus to reduce the masses in rotation.

According to alternative embodiments of the invention which are not shown, accumulation discs 50 and driving elements 60 may be made of injected plastic material in which metal inserts are provided at the places which are in friction contact with other elements. For example, discs 50 may comprise a ring in their frontal face 64 facing driving surface 62 of elements 60 and intended to come into friction contact with driving surface 62, sleeves in the holes of passage 52, and a ring for mounting disc 50 on support shaft 54. Driving element 60 may itself comprise an insert in the shape of a ring placed in rim 72, the frontal surface of which forms driving surface 62.

Figure 3:
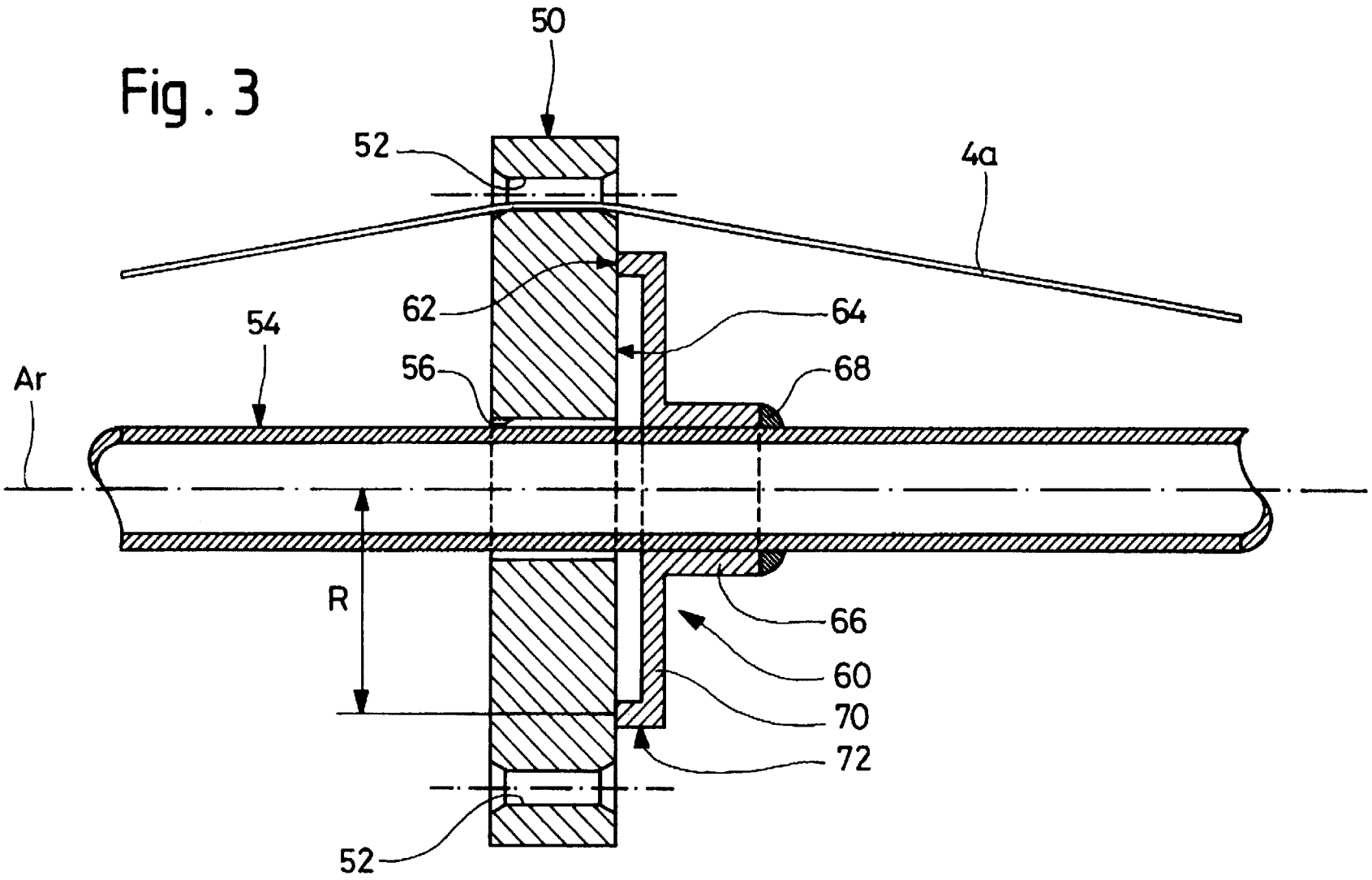
FIG. 3 is a cross-section showing an accumulation element and its driving means according to one embodiment of the invention.
Figure 4:
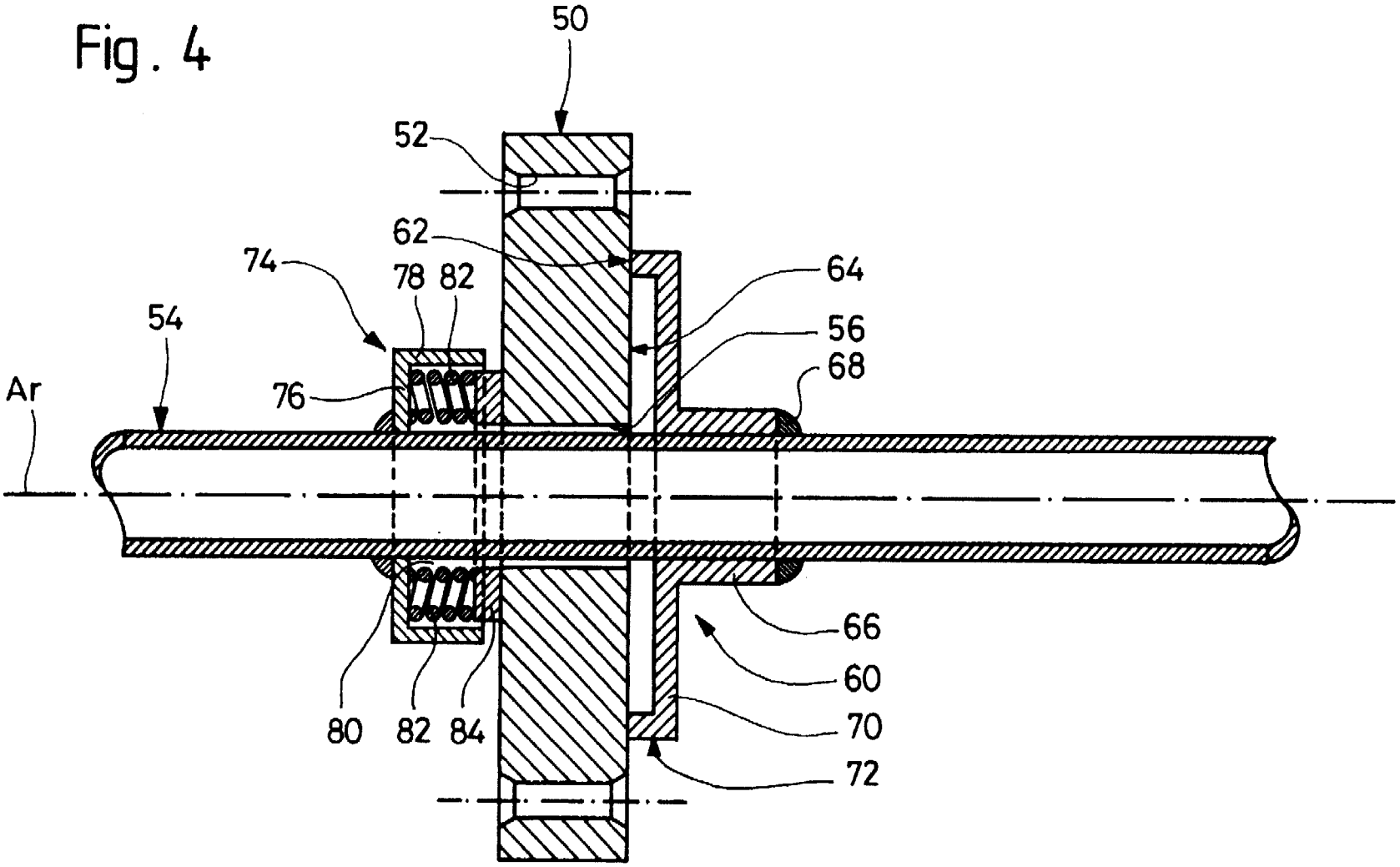
FIG. 4 is a cross-section showing an accumulation element and its driving means according to an alternative embodiment of the invention.

Referring to FIG. 4, one sees an alternative embodiment of accumulation means 32 according to the invention in which the same elements as those already described in connection with FIGS. 1 to 3 have the same numerical references.

Accumulation means 32 shown in this figure differ from those previously described in that they also comprise a device 74 associated with each accumulation disc 50. This device 74 enables accumulation disc 50 to be applied against driving surface 62 of the driving element 60 with which it is associated. More precisely, this device 74 enables, as a complement to the friction forces generated by the forward motion of wire strands 4*a*–4*g* in passage holes 52, to apply permanently an axial force on accumulation disc 50. The latter is thus driven in rotation by driving element 60 whatever the orientation of wire strands *4a–4g* passing passage holes 52 and in particular when their orientation is parallel to the stranding axis and the friction force component is weak in this direction.

In the example illustrated, device 74 rotates with shaft 54 and is disposed upstream of accumulation disc 50 in relation to the forward motion direction of the wire strands. Device 74 comprises a circular cap having a base 76 through which support shaft 54 passes, and an annular wall 78 extending parallel to shaft 54 and at a distance from the latter. The external surface of shaft 54, base 76 and annular wall 78 thus define a recess 80 in which are housed prestressed springs and a friction washer, intended to come into contact with the frontal face opposite face 64 of accumulation disc 50.

In FIG. 4, the position of the cap is fixed in relation to shaft 54, the cap being welded by its base 76 directly onto this shaft so that the force generated by spring 82 on the washer 84 and consequently on disc 50 is selected once for all at the time of assembling.

However, the man skilled in the art could easily provide according to an alternative embodiment such a device 74 with means for regulating the prestressing of springs 82, for example with the aid of a screw and nut system enabling the position of the cap along support shaft 54 to be adjusted, and the device to be dismantled.

What is claimed is:

1. A stranding station for stranding machines of the SZ type intended to join or assemble helically a plurality of individual wire strands, said stranding station comprising:

a plurality of fixed guide means for guiding the wire strands, stranding means comprising a stranding element which is able to rotate about an axis, accumulation means, disposed between said guide means and said stranding means, for feeding said wire strands, and comprising at least one accumulation element, said wire strands passing through each of said guide means, said stranding means and said accumulation means, a support shaft having an axis extending between the guide means and the stranding means, said support shaft carrying said accumulation means, means for alternately driving said stranding element in rotation in opposite directions, means for driving said accumulation element in rotation simultaneously with said stranding element, wherein said support shaft is driven in rotation in conjunction with said stranding element, wherein said accumulation element is mounted so that it is free to rotate about said support shaft and free to move along the axis of said support shaft, wherein the rotation driving means of the accumulation element comprises an intermediate element attached to the support shaft, and disposed downstream of the accumulation element in relation to the forward motion direction of the wire strands, wherein the intermediate element comprises a driving surface, and wherein the accumulation element may be applied against said driving surface and thus be driven in rotation by friction of said driving surface against the accumulation element.

2. A stranding station according to claim 1, wherein said accumulation element is generally disc-shaped and wherein said intermediate element comprises a ring surrounding the shaft and prolonged at one of its ends by a flange comprising on its frontal face said driving surface.

3. A stranding station according to claim 2, wherein said flange comprises at its periphery an annular rim which extends axially and wherein the frontal face of this rim forms said driving surface.

4. A stranding station according to claim 2, wherein said device, is attached to said support shaft and arranged upstream of the accumulation disc in relation to the forward motion direction of the wire strands.

5. A stranding station according to claim 1, wherein said means for driving said accumulation element in rotation further comprises a device enabling said accumulation element to be permanently applied against said driving surface.

6. A stranding station according to claim 5, wherein said device comprises a spring acting on a friction ring which comes into friction contact with the accumulation element.

7. A stranding station according to claim 1, further comprising a plurality of accumulation elements each associated with an intermediate driving element.

8. A stranding element according to claim 7, wherein the friction driving torque transmitted to the accumulation element via the intermediate element, increases from the fixed guide means to the stranding means.

9. A stranding station according to claim 8, wherein the driving torque varies as a function, of the friction coefficient between the material respectively of the intermediate elements and the accumulation elements.

10. A stranding station according to claim 8, wherein the driving torque varies as a function of the radius defined by the distance separating the friction surface from the axis of rotation of the support shaft.

11. A stranding station according to claim 7, wherein the accumulation elements are mounted equidistant from each other on the support shaft.

12. A stranding station according to claim 1, wherein the accumulation elements and the intermediate elements comprise lightening recesses.

13. A stranding element according to claim 1, wherein the accumulation and intermediate elements are made in light metal alloys.

14. A stranding station according to claim 1, wherein the support shaft has the shape of a tube through which the core of the cable to be manufacture is intended to pass.

15. A stranding station according to claim 1, further comprising a stranding die arranged downstream of the stranding element in relation to the forward motion direction of the wire strands.

* * * * *